United States Patent [19]

Moomaw

[11] Patent Number: 4,955,840

[45] Date of Patent: Sep. 11, 1990

[54] TOY SOUND-EMITTING AND BUBBLE-BLOWING SAXOPHONE

[75] Inventor: David E. Moomaw, East Aurora, N.Y.

[73] Assignee: The Quaker Oats Company, Chicago, Ill.

[21] Appl. No.: 394,014

[22] Filed: Aug. 15, 1989

[51] Int. Cl.[5] ..... A63H 33/28; A63H 5/00

[52] U.S. Cl. ..... 446/17; 446/20; 446/203

[58] Field of Search ..... 446/17, 16, 15, 19, 446/20, 21, 18, 202, 203, 204, 205, 206, 207, 208, 209

[56] References Cited

U.S. PATENT DOCUMENTS

| | | | |
|---|---|---|---|
| 2,393,039 | 1/1946 | Gilchrist, Jr. | 446/17 |
| 2,700,245 | 1/1955 | Kratt et al. | 446/17 |
| 2,989,818 | 6/1961 | Filger et al. | 446/20 |
| 3,247,748 | 4/1966 | Glass et al. | 446/202 X |
| 3,420,133 | 1/1969 | Proll | 446/205 X |
| 3,604,144 | 9/1971 | Span | 446/17 |
| 4,423,565 | 1/1984 | Bart | 446/16 |
| 4,804,346 | 2/1989 | Sheng | 446/17 |

FOREIGN PATENT DOCUMENTS

| | | | |
|---|---|---|---|
| 623443 | 2/1963 | Belgium | 446/20 |
| 487367 | 10/1952 | Canada | 446/18 |
| 474784 | 12/1953 | Italy | 446/20 |
| 596814 | 1/1948 | United Kingdom | 446/20 |

*Primary Examiner*—Robert A. Hafer
*Assistant Examiner*—D. Neal Muir
*Attorney, Agent, or Firm*—Cumpston & Shaw

[57] ABSTRACT

A toy saxophone is disclosed having a mouthpiece, a sound-emitting mechanism, a bubble-blowing mechanism, and air tubes connecting the mouthpiece to the sound-emitting and bubble-blowing mechanisms. The toy saxophone further has an actuating mechanism comprising a manually depressible button coupled to the sound-emitting and bubble-blowing mechanisms whereby simultaneously blowing into the mouthpiece and depressing the button causes sound to be emitted from the sound-emitting mechanism and bubbles to be blown from the bubble-blowing mechanism.

5 Claims, 3 Drawing Sheets

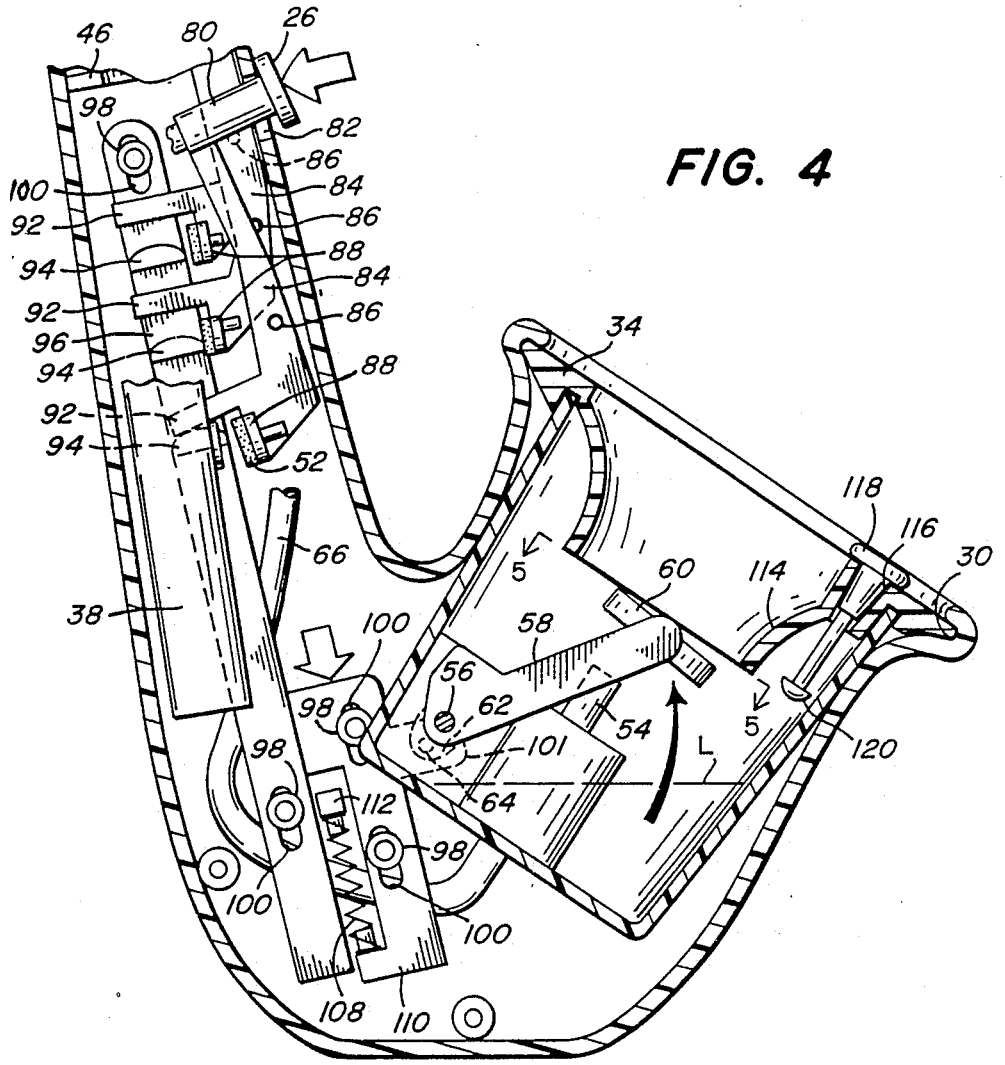
FIG. 4
FIG. 6
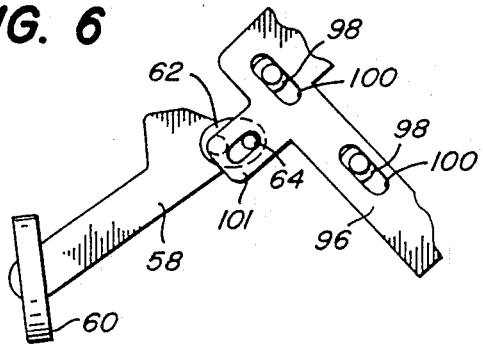
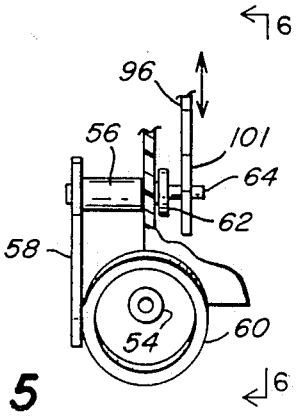
FIG. 5

TOY SOUND-EMITTING AND BUBBLE-BLOWING SAXOPHONE

BACKGROUND OF THE INVENTION

1. Field of the Invention

The present invention relates generally to toy saxophones, and more particularly to a toy sound-emitting and bubble-blowing saxophone.

2. Description of the Prior Art

Children tend to spend a considerable amount of their time indulging in the world of play, fantasy and make-believe. One facet of a child's fantasy world involves the entertainment industry, more specifically toy musical instruments.

To indulge them, the toy industry is challenged to provide musical instruments that can produce new, more entertaining or more interesting action. For example, U.S. Pat. No. 2,989,818, which issued to J. B. Filger, et al., on June 27, 1961, discloses a bubble-blowing trumpet adapted when air is blown into the mouthpiece to produce a single musical sound. Also, when a button is depressed, a bubble liquid film is placed in the path of air blown into the mouthpiece to produce bubbles. The trumpet also has a spill-proof reservoir that prevents spillage of liquid from the trumpet no matter what position it is placed in.

The toy saxophone of this invention is adapted, upon depression of a button, to actuate sound-emitting and bubble-blowing mechanisms for simultaneously generating a musical sound and emitting bubbles, thereby providing a toy saxophone that is more entertaining, interesting, and amusing to children.

SUMMARY OF THE INVENTION

An object of this invention is to provide a toy saxophone that simultaneously emits sounds and bubbles. The toy saxophone comprises:

a mouthpiece;

sound-emitting means;

bubble-blowing means;

air passage means connecting the mouthpiece to the sound-emitting means and bubble-blowing means;

a manually depressible button; and means for coupling the manually depressible button to the sound-emitting means and bubble-blowing means whereby simultaneously blowing into the mouthpiece and depressing the button causes sound to be emitted from the sound emitting means, and bubbles to be blown from the bubble-blowing means.

A more specific object of the invention is to provide a toy sound-emitting and bubble-blowing saxophone, comprising:

a saxophone housing having a mouthpiece at one end and a bubble liquid-holding cup at the other end;

an air nozzle in the bubble liquid-holding cup extending above the level of the bubble liquid in the bubble liquid-holding cup;

a wand mounted in the bubble liquid-holding cup and movable between a normal first position in which it is immersed in the bubble liquid, and a second position in which it positions a bubble liquid film formed on the wand in register with the air nozzle;

a first air passage in the saxophone housing connecting the mouthpiece to the air nozzle;

sound means mounted in the housing comprising a sound manifold, a reed in the manifold, a hole manifold, and a valve pad for closing and opening the hole;

a second air passage in the saxophone housing connecting the mouthpiece to the sound manifold; and a valve pad and wand actuating means comprising a lever having a manually operated button at one end mounted for reciprocal movement in a wall of the housing, and having an opposite lever end coupled to the valve pad and wand whereby simultaneously blowing into the mouthpiece and depressing the button causes the valve pad to open the hole and the wand to move to its second position causing sound to be emitted from the sound manifold and bubbles to be blown from the wand.

BRIEF DESCRIPTION OF THE DRAWINGS

In the detailed description of the invention presented below, reference is made to the accompanying drawings, in which:

FIG. 4 is a segmental enlarged view of a portion of the saxophone of FIG. 3 showing a button depressed and the position of the valve pad and wand in response thereto;

FIG. 5 is a segmental view taken substantially along line 5—5 of FIG. 4; and FIG. 6 is a segmental view taken substantially from line 6—6 of FIG. 5.

DETAILED DESCRIPTION OF THE PREFERRED EMBODIMENTS

Figures 1, 2:
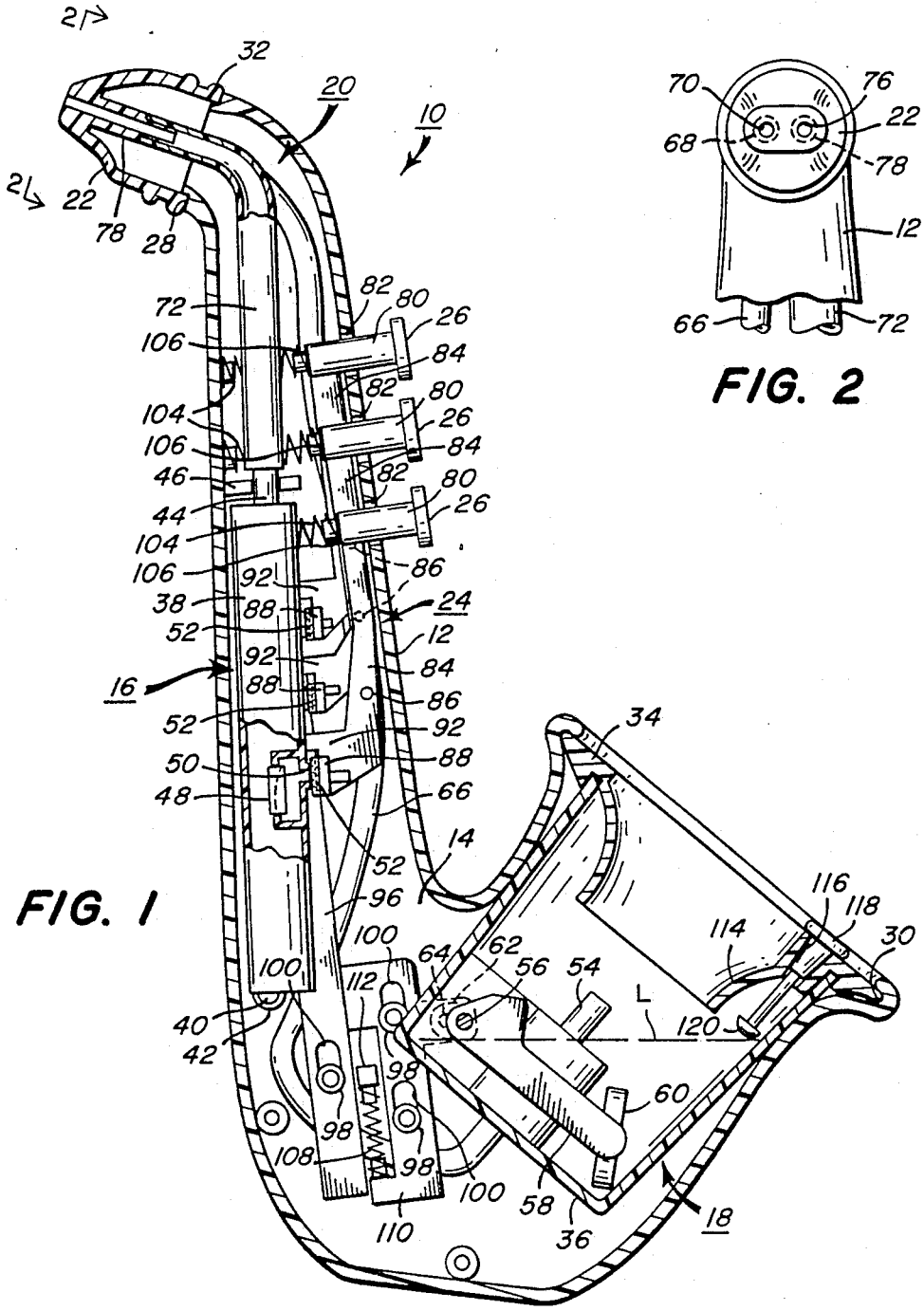
FIG. 1 is a side-elevational view of a preferred embodiment of the toy saxophone of this invention with half of the housing removed to show the air tubes, sound-emitting and bubble-blowing mechanisms, and button actuating mechanism therefor.
FIG. 2 is a front segmental view of the mouthpiece of the toy saxophone of FIG. 1.

With reference to FIGS. 1 and 2, a preferred embodiment of a toy saxophone 10 of this invention is disclosed comprising a molded body housing 12 in the general shape of a saxophone. The housing 12 is preferably formed of two half sections, joined together by screws or the like, to form a cavity 14 within which is mounted a sound-emitting means 16, a bubble-blowing means 18, air tube means 20 connecting a mouthpiece 22 of the saxophone 10 to the sound-emitting means 16 and bubble-blowing means 18, and lever actuating means 24 for coupling a manually depressible button 26 of the lever actuating means to the sound-emitting means 16 and bubble-blowing means 18.

The housing 12 has outer and inner annular grooves 28, 30 respectively at each end thereof, groove 28 for receiving a peripheral lip 32 on mouthpiece 22, and groove 30 for receiving a peripheral rim 34 on a bubble liquid-holding cup 36.

The saxophone sound-emitting means 16 comprises a cylindrical sound manifold 38 mounted within the housing cavity 14. The mounting is achieved by a depending pin 40 at one end of the manifold insertable into a blind bore in a boss 42 on the housing 12, and a hollow neck 44 at the opposite end of the manifold that is captured within U-shaped notches in mating flanges 46 in the housing. The cYlindrical manifold 38 houses three separate reeds 48, only one of which is shown, capable of providing three different sounds, and further has three spaced holes 50, only one of which is shown, in the manifold wall, which cooperate with individual valve pads 52 to produce musical sounds in a manner well-known in the art.

In addition to the bubble liquid-holding cup 36, the bubble-blowing means 18 comprises an air nozzle 54 in the bubble liquid-holding cup extending above the level of the bubble liquid L in the bubble liquid-holding cup 36. The lower end of the cup rotatably supports a shaft 56 having an arm 58 extending laterally from one end thereof for supporting an annular bubble-blowing wand 60 of the conventional type found in the bubble-blowing art. A crank 62 is secured to the opposite end of the shaft 56, having an eccentric pin 64 at one end thereof. The wand 60 is movable by the eccentric pin 64 between a first position in which the arm 58 and wand 60 are immersed in the bubble liquid L as seen in FIG. 1, and a second position in which the arm and wand are raised to position the wand in register with the air nozzle 54, as seen in FIG. 4. As the wand 60 emerges from the bubble liquid, a soapy film is formed across the wand which is raised into register with the air nozzle 54. A first tube 66 has one end thereof connected to the air nozzle 54 and the opposite end thereof connected to a nipple 68 and first opening 70 in the mouthpiece 22. A second tube 72 connects the neck 44 on the sound manifold 38 to a second opening 76 and nipple 78 in the mouthpiece 22. Alternatively, the first and second tubes can merge into a common tube connected to a nipple and single opening in the mouthpiece.

Figure 3:
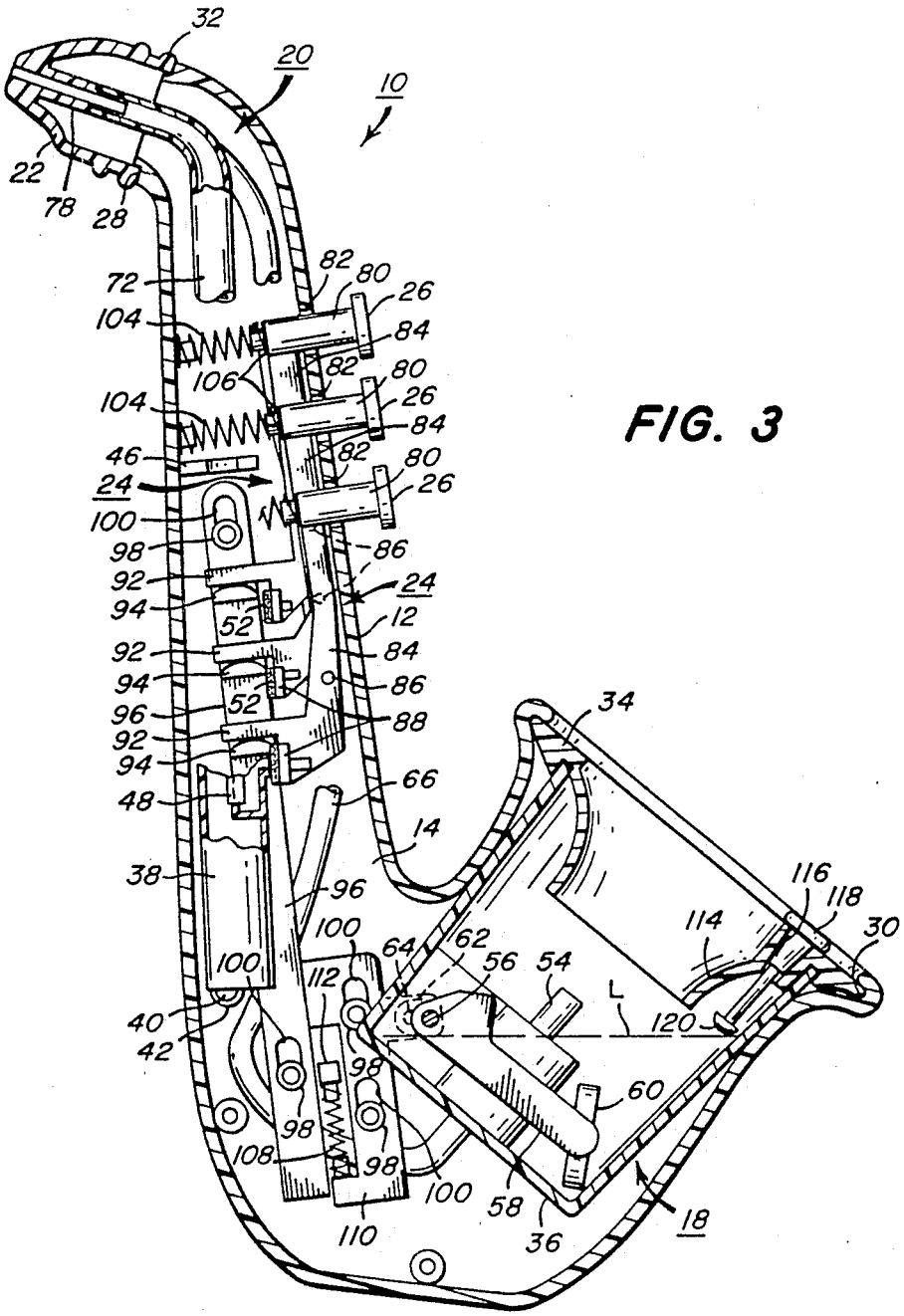
FIG. 3 is a view similar to FIG. 1 with a portion of the sound-emitting mechanism removed to better show the button actuating mechanism for the sound-emitting and bubble-blowing mechanisms.

The sound-emitting means 16 and bubble-blowing means 18 are simultaneously actuated by one or more of the buttons 26 that are manually depressed by a child playing the saxophone 10. The buttons 26 have depending plates 80 that are reciprocally movable within slots 82 in the housing 12, and the ends of the plates 80 are secured to ends of levers 84 pivotally mounted to the housing on pivots 86. The opposite ends of the levers 84 are provided with laterally extending flanges 88 having pads 52 secured by any suitable means to the undersurface thereof. The buttons 26 are further coupled to the eccentric pin 64 by fingers 92, seen best in FIGS. 3 and 4, on the opposite ends of the levers 84 engageable with shoulders 94 on an L-shaped plate 96. The L-shaped plate is mounted for reciprocal movement within the housing 12 by headed pins 98 on the housing extending through elongated slots 100 in the plate 96. The L-shaped end of the plate 96 has a finger 101 having a slotted opening 102 for receiving the eccentric pin 64 of the bubble-blowing means 18. Accordingly, when a child blows into the mouthpiece 22 of the saxophone 10 and simultaneously presses one of the buttons 26, as shown in FIG. 4, the valve pad 52 is raised from the opening 50 and the air blown into the sound manifold 38 will actuate a reed 48, causing the sound-emitting means 16 to emit a sound. Depression of the button 26 also causes the wand 60 to be moved from the bubble liquid L positioning a soapy bubble liquid film in register with the air nozzle 54, as seen in FIG. 4, for generating bubbles by the air blown through the first tube 66.

Springs 104 are interposed between ends 106 of each of the button plates 80 and the housing 12. Also, a spring 108 is interposed between a laterally extending finger 110 on plate 96 and a boss 112 on housing 12 for returning the buttons 26 to their normal undepressed condition, and the wand 60 to its normal first position, in which it is immersed in the bubble liquid. The rim 34 of the bubble liquid-holding cup 36 is further provided with an annular lip 114 to prevent the bubble liquid L from spilling out of the saxophone 10 when the child changes the orientation of the saxophone by, for example, laying it on its side or turning it upside down. Also, rim 34 is provided with a V-shaped opening 116 through which bubble liquid can be poured into and out of the cup 36. A cork 118 is used to close off opening 116, and is provided with a stop head 120 to prevent the cork from becoming detached from the rim.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims

What is claimed is:

1. A toy sound-emitting and bubble-blowing saxophone comprising:

a mouthpiece;

sound-emitting means;

bubble-blowing means;

air passage means connecting the mouthpiece to the sound-emitting means and bubble-blowing means;

a manually depressible button; and linkage means activated by the button for coupling the manually depressible button to the sound-emitting means and to the bubble-blowing means, whereby depressing the button while blowing into the mouthpiece changes the sound emitted from the sound-emitting means and enables bubbles to be blown from the bubble-blowing means.

2. A toy sound-emitting and bubble-blowing saxophone according to claim 1, wherein the sound-emitting means comprises a sound manifold mounted in the housing and having a sound generating element therein, a hole in the manifold, and a valve pad for closing and opening the hole, the bubble-blowing means comprising a bubble liquid-holding cup for holding a supply of bubble liquid at a normal bubble liquid level, an air nozzle in the bubble liquid-holding cup extending above the normal bubble liquid level, in the bubble liquid-holding cup, and a wand mounted in the bubble liquid-holding cup and movable between a first position below the normal bubble liquid level, and a second position in register with the air nozzle, and the coupling means comprises a valve-pad actuating lever having one end connected to the button and its opposite end connected to the valve pad, and a reciprocally movable plate having one portion thereof connected to the wand and a shoulder thereon engageable by the valve pad actuating lever.

3. A toy sound-emitting and bubble-blowing saxophone comprising:

a saxophone body housing having a mouthpiece at one end and a bubble liquid-holding cup at another end;

an air nozzle in the bubble liquid-holding cup extending above a normal bubble liquid level in the bubble liquid-holding cup;

wand means comprising a wand mounted in the bubble liquid-holding cup and movable between a first position below the normal bubble liquid level, and a second position in register with the air nozzle;

a first air passage in the saxophone housing connecting the mouthpiece to the air nozzle;

sound means mounted in the housing comprising a sound manifold, a sound generating element in the manifold, a hole in the manifold, and a valve pad for closing and opening the hole;

a second air passage in the saxophone housing connecting the mouthpiece to the manifold;

a valve pad and wand actuating means comprising a reciprocally movable plate coupled to the wand, and a lever having a manually operated button at one end mounted for reciprocal movement in a wall of the housing, and having a flange on an opposite end of the lever coupled to the valve pad, and a finger adjacent to the flange and coupled to the plate whereby simultaneously blowing into the mouthpiece and depressing the button causes the valve pad to open the hole and the wand to move to its second position, causing sound to be emitted from the sound manifold, and enables bubbles to be blown from the wand.

4. A toy saxophone according to claim 3, wherein the wand means comprises an arm to which the wand is secured at one end, a rotatably movable shaft secured to an opposite end of the arm, and an eccentric pin mounted on one end of the shaft for pivotally moving the arm and wand, and wherein the plate is coupled to the wand by a slotted opening therein receiving the eccentric pin, and wherein the finger is coupled to the plate by a shoulder on the plate engageable by the finger on the actuating lever.

5. A toy sound-emitting and bubble-blowing saxophone according to claim 4, and wherein the bubble liquid-holding cup further has a peripheral spill-proof lip for preventing the liquid from spilling out of the cup in all positions of the saxophone.

* * * * *